US007431823B2

(12) United States Patent
Farshid et al.

(10) Patent No.: US 7,431,823 B2
(45) **Date of Patent: *Oct. 7, 2008**

(54) PROCESS FOR UPGRADING HEAVY OIL USING A HIGHLY ACTIVE SLURRY CATALYST COMPOSITION

(75) Inventors: Darush Farshid, Larkspur, CA (US); Bruce Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 254 days.

This patent is subject to a terminal disclaimer.

(21) Appl. No.: 11/305,377

(22) Filed: Dec. 16, 2005

(65) Prior Publication Data

US 2007/0138057 A1 Jun. 21, 2007

(51) Int. Cl.
*C10B 57/02* (2006.01)
*C10G 51/02* (2006.01)

(52) U.S. Cl. ..... 208/57; 208/78; 208/49; 208/58; 208/61; 208/68; 208/95; 208/210; 208/212; 208/213

(58) Field of Classification Search ..... 208/57, 208/78, 49, 59, 61, 68, 95, 210, 212, 213
See application file for complete search history.

(56) References Cited

U.S. PATENT DOCUMENTS 3,817,856 A * 6/1974 Aaron et al. ..... 208/213
4,684,456 A 8/1987 Van Driesen et al.
5,371,308 A * 12/1994 Gosselink et al. ..... 585/251
5,527,473 A * 6/1996 Ackerman ..... 210/767
5,871,638 A * 2/1999 Pradhan et al. ..... 208/422
6,139,723 A * 10/2000 Pelrine et al. ..... 208/422
6,190,542 B1 * 2/2001 Comolli et al. ..... 208/423
6,278,034 B1 8/2001 Espinoza et al.
6,454,932 B1 9/2002 Baldassari et al.
6,660,157 B2 * 12/2003 Que et al. ..... 208/108
6,726,832 B1 4/2004 Baldassari et al.

OTHER PUBLICATIONS

U.S. Appl. No. 10/938,202 filed Sep. 10, 2004, entitled "Highly Active Slurry Catalyst Composition", 14 pages.
U.S. Appl. No. 10/9380,003 filed Sep. 10, 2004, entitled "Highly Active Slurry Catalyst Composition", 13 pages.
U.S. Appl. No. 10/938,438 filed Sep. 10, 2004, entitled "Process for Recycling an Active Slurry Catalyst Composition in Heavy Oil Upgrading", 15 pages.
U.S. Appl. No. 10/938,200 filed Sep. 10, 2004, entitled "Process for Upgrading Heavy Oil Using a Highly Active Slurry Catalyst Composition", 17 pages.
U.S. Appl. No. 10/938,269 filed Sep. 10, 2004, entitled "Process for Upgrading Heavy Oil Using a Highly Active Slurry Catalyst Composition", 19 pages.

* cited by examiner

*Primary Examiner*—Tam M Nguyen
(74) *Attorney, Agent, or Firm*—Penny L. Prater

(57) ABSTRACT

The instant invention is directed to a new residuum full hydroconversion slurry reactor system that allows the catalyst, unconverted oil and converted oil to circulate in a continuous mixture throughout an entire reactor with no confinement of the mixture. The mixture is partially separated in between the reactors to remove only the products and hydrogen, while permitting the unconverted oil and the slurry catalyst to continue on into the next sequential reactor where a portion of the unconverted oil is converted to lower boiling point hydrocarbons, once again creating a mixture of unconverted oil, converted oil, and slurry catalyst. Further hydroprocessing may occur in additional reactors, fully converting the oil. The oil may alternately be partially converted, leaving a highly concentrated catalyst in unconverted oil which can be recycled directly to the first reactor.

11 Claims, 1 Drawing Sheet

PROCESS FOR UPGRADING HEAVY OIL USING A HIGHLY ACTIVE SLURRY CATALYST COMPOSITION

FIELD OF THE INVENTION

The instant invention relates to a process for upgrading heavy oils using a slurry catalyst composition.

BACKGROUND OF THE INVENTION

There is an increased interest at this time in the processing of heavy oils, due to increased worldwide demand for petroleum products. Canada and Venezuela are sources of heavy oils. Processes which result in complete conversion of heavy oils feeds to useful products are of particularly interest.

The following patents, which are incorporated by reference, are directed to the preparation of highly active slurry catalyst compositions and their use in processes for upgrading heavy oil:

U.S. Ser. No. 10/938,202 is directed to the preparation of a catalyst composition suitable for the hydroconversion of heavy oils. The catalyst composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

U.S. Ser. No. 10/938,003 is directed to the preparation of a slurry catalyst composition. The slurry catalyst composition is prepared in a series of steps, involving mixing a Group VIB metal oxide and aqueous ammonia to form an aqueous mixture and sulfiding the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,438 is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

U.S. Ser. No. 10/938,200 is directed to a process for upgrading heavy oils using a slurry composition. The slurry composition is prepared in a series of steps, involving mixing a Group VIB metal oxide with aqueous ammonia to form an aqueous mixture and sulfiding the mixture to form a slurry. The slurry is then promoted with a Group VIII metal compound. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,269 is directed to a process for upgrading heavy oils using a slurry composition. The slurry composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

SUMMARY OF THE INVENTION

A process for the hydroconversion of heavy oils, said process employing at least two upflow reactors in series with a separator in between each reactor, said process comprising the following steps:

(a) combining a heated heavy oil feed, an active slurry catalyst composition and a hydrogen-containing gas to form a mixture;

(b) passing the mixture of step (a) to the bottom of first reactor, which is maintained at slurry hydroprocessing conditions, including elevated temperature and pressure;

(c) removing a vapor stream comprising products, hydrogen, unconverted material and slurry catalyst from the top of the first reactor and passing it to a first separator;

(d) in the first separator, removing the products and hydrogen overhead as a vapor stream to further processing and passing a liquid bottoms stream, comprising unconverted material and slurry catalyst, to the bottom of the second reactor, which is maintained at slurry hydroprocessing conditions, including elevated temperature and pressure;

(e) removing a vapor stream comprising products and hydrogen, unconverted material and slurry catalyst from the top of the second reactor and passing it to a second separator;

(f) in the second separator, removing the products and hydrogen overhead as a vapor stream to further processing and passing a bottoms stream, comprising unconverted material and slurry catalyst to further processing.

BRIEF DESCRIPTION OF THE FIGURE

The FIGURE depicts a process scheme of this invention, employing three reactors.

DETAILED DESCRIPTION OF THE INVENTION

Figure 1:
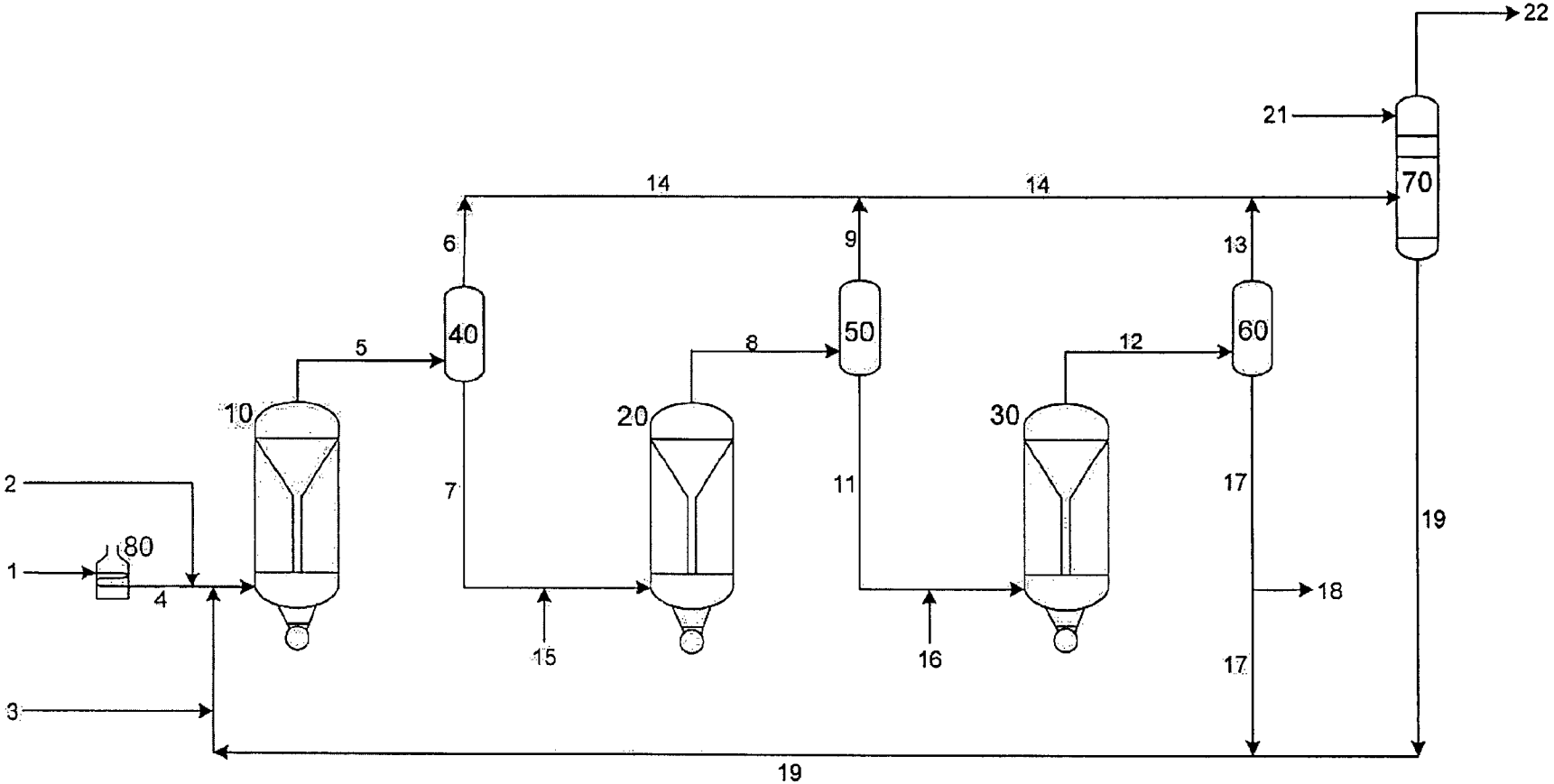

The process for the preparation of the catalyst slurry composition used in this invention is set forth in U.S. Ser. No. 10/938,003 and U.S. Ser. No. 10/938,202 which are incorporated by reference. The catalyst composition is useful for but not limited to hydrogenation upgrading processes such as thermal hydrocracking, hydrotreating, hydrodesulphurization, hydrodenitrification, and hydrodemetalization.

The feeds suitable for use in this invention are set forth in U.S. Ser. No. 10/938,269 and include atmospheric residuum, vacuum residuum, tar from a solvent deasphalting unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers. Suitable feeds also include atmospheric residuum, vacuum residuum and tar from a solvent deasphlating unit.

The preferred type of reactor in the instant invention is a liquid recirculating reactor, although other types of upflow reactors may be employed. Liquid recirculating reactors are discussed further in copending application Ser. No. 10/702,751 (T6493) which is incorporated by reference.

A liquid recirculation reactor is an upflow reactor to which is fed heavy hydrocarbon oil admixed with slurry catalyst and a hydrogen rich gas at elevated pressure and temperature, for hydroconversion.

Hydroconversion includes processes such as hydrocracking and the removal of heteroatom contaminants (such sulfur and nitrogen). In slurry catalyst use, catalyst particles are extremely small (1-10 micron). Pumps are not generally needed for recirculation, although they may be used. Sufficient motion of the catalyst is usually established without them.

The FIGURE illustrates the preferred embodiment of this invention. The instant invention is directed to a process for catalyst activated slurry hydrocracking. Stream 1 comprises a heavy feed, such as vacuum residuum. This feed enters furnace 80 where it is heated, exiting in stream 4. Stream 4 combines with a hydrogen containing gas (stream 2), and a stream comprising an active slurry composition (stream 23), resulting in a mixture (stream 24). Stream 24 enters the bottom of the first reactor 10. Vapor stream 5 exits the top of the reactor 10, comprising slurry, products and hydrogen, and unconverted material. Stream 5 passes to separator 40, which is preferably a flash drum. Products and hydrogen are removed overhead as stream 6. Liquid stream 7 is removed through the bottom of the flash drum. Stream 7 contains slurry in combination with unconverted oil.

Stream 7 is combined with a gaseous stream comprising hydrogen (steam 15) to create stream 25. Stream 25 enters the bottom of second reactor 20. Vapor stream 8, comprising products, hydrogen, slurry and unconverted material passes to separator 50, preferably a flash drum. Product and hydrogen, in a vapor stream is removed overhead as stream 9. Liquid stream 11 is removed through the bottom of the flash drum. Stream 11 contains slurry in combination with unconverted oil.

Stream 11 is combined with a gaseous stream comprising hydrogen (stream 16) to create stream 26. Stream 26 enters the bottom of third reactor 30.

Vapor stream 12, comprising products, hydrogen, slurry and unconverted material passes overhead from reactor 30 to separator 60, preferably a flash drum. Products and hydrogen are removed overhead as vapor stream 13. Liquid stream 17 is removed through the bottom of the flash drum. Stream 17 contains slurry in combination with unconverted oil. A portion of this stream may be drawn off through stream 18.

Overhead streams 6, 9 and 13 create stream 14, which passes to high pressure separator 70. Stream 21, comprising a lean oil such as vacuum gas oil enters the top portion of high pressure separator 70. Products and hydrogen exit lean oil contactor 70 overhead as vapor stream 22, while liquid stream 19 exits at the bottom. Stream 19 comprises a mixture of slurry and unconverted oil. Stream 19 is combined with stream 17, which also comprises a mixture of slurry and unconverted oil. Fresh slurry is added in stream 3, and stream 23 is created. Stream 23 is combined with the feed to first reactor 10.

What is claimed is:

1. A process for the hydroconversion of heavy oils, said process comprising the following steps:

(a) providing at least two upflow reactors in series, a first reactor and a second reactor, with a separator in between each reactor;

(b) combining a heated heavy oil feed, an active slurry catalyst composition and a hydrogen-containing gas to form a mixture;

(c) passing the mixture of step (b) to the bottom of the first reactor, which is maintained at hydroprocessing conditions, including elevated temperature and pressure;

(d) removing a vapor stream comprising products, hydrogen, unconverted material and slurry catalyst from the top of the first reactor and passing it to a first separator;

(e) in the first separator, removing the products and hydrogen to further processing and passing a liquid bottoms stream, comprising unconverted material and slurry catalyst, to the bottom of the second reactor, which is maintained at slurry hydroprocessing conditions, including elevated temperature and pressure;

(f) removing a vapor stream comprising products and hydrogen unconverted material and slurry catalyst from the top of the second reactor and passing it to a second separator;

(g) in the second separator, removing the products and hydrogen overhead as a vapor stream to further processing and passing a bottoms stream, comprising unconverted material and slurry catalyst to further processing (h) Wherein the bottoms material of step (g) is recycled to step (b), the mixture of step (b) further comprising recycled unconverted material and slurry catalyst.

2. The process of claim 1, wherein the bottoms material of step (f) is passed to the bottom of a third reactor which is maintained at hydroconversion conditions, including elevated temperature and pressure.

3. The process of claim 1, in which at least one of the reactors is a liquid recirculating reactor.

4. The process of claim 3, in which the recirculating reactor employs a pump.

5. The process of claim 1, in which hydroprocessing conditions employed in each reactor comprise a total pressure in the range from 1500 through 3500 psia and temperature from 700 through 900 F.

6. The process of claim 1, in which the total pressure is preferably in the range from 2000 through 3000 psia and temperature is preferably in the range from 775 through 850 F.

7. The process of claim 1, wherein the separator located between each reactor is a flash drum.

8. The hydroconversion process of claim 1, wherein the heavy oil is selected from the group consisting of atmospheric residuum, vacuum residuum, tar from a solvent deasphlating unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

9. The hydroconversion process of claim 1, wherein the process is selected from the group consisting of hydrocracking, hydrotreating, hydrodesuiphurization, hydrodenitrification, and hydrodemetalization.

10. The process of claim 1, wherein the active slurry catalyst composition of claim 1 is prepared by the following steps:

(a) mixing a Group VIB metal oxide and aqueous ammonia to form a Group VI B metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with a hydrocarbon oil having a viscosity of at least 2 cSt @212° F. to form an intermediate mixture;

(e) combining the intermediate mixture with hydrogen gas in a second reaction zone, under conditions which maintain the water in the intermediate mixture in a liquid phase, thereby forming an active catalyst composition admixed with a liquid hydrocarbon; and (f) recovering the active catalyst composition.

11. The process of claim 1, in which about 98 wt % of heavy oil feed is converted to lighter products.

* * * * *